US005661970A

United States Patent [19]

Müller et al.

[11] Patent Number: 5,661,970

[45] Date of Patent: Sep. 2, 1997

[54] THRUST-GENERATING DEVICE

[75] Inventors: Wolfgang Müller, Möckmühl; German Munding, Bad Friedrichshall, both of Germany

[73] Assignee: Daimler-Benz Aerospace AG, Münich, Germany

[21] Appl. No.: 431,140

[22] Filed: Apr. 28, 1995

[30] Foreign Application Priority Data

Apr. 30, 1994 [DE] Germany ..... 44 15 259.0

[51] Int. Cl.[6] ..... F02K 9/38; F02K 9/50

[52] U.S. Cl. ..... 60/223; 60/224; 60/258; 60/259

[58] Field of Search ..... 60/223, 224, 258, 60/259

[56] References Cited

U.S. PATENT DOCUMENTS

| | | | |
|---|---|---|---|
| 3,098,353 | 7/1963 | Abild | 60/259 |
| 3,098,625 | 7/1963 | Thielman | 60/224 |
| 3,736,749 | 6/1973 | Kretschmer et al. | 60/258 |
| 3,842,598 | 10/1974 | Forsten | 60/259 |

FOREIGN PATENT DOCUMENTS

| | | | |
|---|---|---|---|
| 20 57 326 | 5/1972 | Germany . | |
| 2057326 | 5/1972 | Germany | 60/224 |
| 35 31 686 | 12/1986 | Germany . | |
| 35 21 204 | 12/1987 | Germany . | |

*Primary Examiner*—Michael Koczo

*Attorney, Agent, or Firm*—McGlew and Tuttle

[57] ABSTRACT

Thrust-generating device with rocket engines arranged in pairs opposite each other for multiple ignition as well as individual and group activation and with an amount of fuel sufficient for the duration of the mission. The thrust-generating device is designed as a closed, storable, modular unit. The rocket engines are operated with liquid fuel and liquid oxidizing agent. At least one tank is provided for each fuel component. The tanks are in the filled, pressureless state before the activation of the thrust-generating device. The rocket engines and a fuel distributor of block design are integrated within a central bulkhead. The thrust-generating device is surrounded by a sealed outer jacket and is divided by the bulkhead into two separate chambers. The outer jacket is lined on the inside with a "self-sealing" film. The oxidizing agent is stored in one chamber, and the fuel in the other chamber. The empty spaces in the chambers contain an adsorbent filling. A temperature-controlled safety device brings about a pulse-free blow-off of the fuels through at least one pair of engines.

20 Claims, 2 Drawing Sheets

THRUST-GENERATING DEVICE

FIELD OF THE INVENTION

The present invention pertains to a thrust-generating device, especially a lateral thrust control device for weapon-carrying missiles and rockets, with rocket engines, which are arranged in pairs and have at least approximately equal thrusts with opposite or approximately opposite directions of thrust, and which are provided for multiple ignition with short combustion time, and can be activated individually and in groups, and with an amount of fuel sufficient for the duration of the mission, which is stored in the area of the rocket engines.

BACKGROUND OF THE INVENTION

A great number of such and comparable thrust-generating devices have been known from the patent literature.

An engine arrangement with at least one longitudinal thrust engine, i.e., a main engine, and a plurality of lateral thrust engines, in which all engines are designed as liquid-fuel engines and separate tanks are provided for the fuel and the oxidizing agent, has been known from DE-PS 20 57 326. All engines are supplied with fuel by a common turbopump system. The engines can be operated individually and together by means of corresponding valves. The fuel supply selected makes the lateral thrust engines dependent on the main engine in terms of design and operation, so that the lateral thrust-generating device cannot be handled, e.g., replaced, retrofitted or used for other purposes, as a separate unit.

The advantages of liquid-fuel engine systems, such as high specific impulse, long to extremely short combustion times, multiple ignitions, etc., are contrasted by major drawbacks in terms of safety engineering. Liquid rocket fuels may be chemically aggressive, especially corrosive, environmentally hazardous or even highly toxic, and, depending on the temperature, they may develop high inherent pressures during storage. At any rate, they are inflammable and explosive, and hypergolic fuel combinations and single-component fuels that can be catalytically activated are especially critical.

These disadvantages have to date prevented any relevant use of liquid-fuel engine systems especially for military purposes, where storage over several years, rough handling and, in the case of defense, shelling, the effect of fire, etc., can be expected. It should also be mentioned that if the tanks leak due to the development of leaks, shelling, etc., liquid rocket fuels are discharged and may very rapidly occupy a large surface, spreading over great distances (generation of gas), which may have devastating consequences, especially in ships, in conjunction with the fire and explosion hazards.

Therefore, despite their disadvantages, such as single ignition, limited controllability of the throughput, fuel depositions in flow channels, valves, etc., no extremely short combustion time, etc., solid rocket fuels are used almost exclusively for the propelling and the lateral thrust control of military missiles, rockets and shells.

Examples of such lateral thrust control devices with solid fuel propellant charges are described in, e.g., DE-OS 35 31 686 and DE-OS 35 21 204.

SUMMARY AND OBJECTS OF THE INVENTION

In light of the prior-art solutions, the primary object of the present invention is to provide a lateral thrust-generating device, which has the advantages of liquid-fuel rocket engine systems and can be handled as unproblematically and safely as corresponding solid-fuel engine systems. In addition, the thrust-generating device shall be able to be mounted and removed as well as activated simply and rapidly.

According to the invention, a device is provided, particularly a lateral thrust-generating device for weapon-carrying missiles and rockets, with rocket engines, which are arranged in pairs and have at least approximately equal thrusts with opposite or approximately opposite directions of thrust. The device is provided for multiple ignitions with short combustion time, and the engines can be activated individually and in groups. The device is provided with an amount of fuel sufficient for the duration of the mission, which is stored in the area of the rocket engines. The objects of the invention are attained by:

a) providing the thrust-generating device as a closed, corrosion-resistant, modular unit, which can be stored for many years, which can be rapidly mounted and removed, and which can be activated and operated at any time from the outside via existing connections;

b) providing the rocket engines as liquid-fuel rocket engines with a separate supply of fuel and oxidizing agent;

c) providing at least one tank for the fuel and providing at least one tank for the oxidizing agent;

d) installing the tanks in a filled state and providing them in a pressureless state before activation of the thrust-generating device, except for the inherent pressure of the fuel;

e) providing a fuel distributor connecting the rocket engines to the tanks having a block-like design, the fuel distributor being integrated with the engines within a central bulkhead;

f) completely surrounding the thrust-generating device, with the exception of the engine nozzles, which are open to the outside, with a gas-tight, pressure-resistant outer jacket, and dividing its inner volume by the bulkhead into two separate chambers;

g) lining the outer jacket on the inside with a "self healing" film;

h) arranging the tank, of which there is at least one, for the fuel in the chamber, on one side of the bulkhead, and arranging the tank, of which there is at least one, for the oxidizing agent, in the chamber, on the other side of the bulkhead, the two tanks being directly or indirectly fastened to the central bulkhead;

i) providing the empty spaces in the two chambers on both sides of the bulkhead with an adsorbent filling; and j) providing a temperature-controlled safety device, which triggers a pulse-free blow-off of the fuels through one or more of engine pairs.

The outer jacket is preferably designed as a metallic, hollow cylindrical body with extensively flat, rotationally symmetrical front plates. The front plates are used for fastening and at the same time also as a Faraday cage (electromagnetic shield). Four rocket engines are preferably arranged, offset by an angle of 90° each, radially oriented, approximately in the center of the hollow cylindrical body. A central bulkhead is preferably designed as a diaphragm double plate. Preferably only one tank is provided for the fuel and one tank is provided for the oxidizing agent, the tanks being separated from one another by a bulkhead.

Preferably two gas generators are provided, each of which can be connected to each of the tanks for pressurizing them.

One of the gas generators is provided for the start phase, and the other is provided for the terminal phase of the flight mission. The gas generator for the start phase has a shorter combustion time than the gas generator for the terminal phase. The gas generator for the terminal phase of the flight mission is separated from the pressurizing line or from the pressurizing lines by a nonreturn valve, and at least one pressure relief valve is installed in the pressurizing system.

Filling connections of the filled tanks are preferably dosed by cold welding. The tanks are closed toward the fuel lines with rupture disks, whose bursting pressure is lower than the operating pressure of the gas generators for pressurizing the tanks. The liquid fuels in the tanks are sealed against the pressurizing gas by means of metallic diaphragms, which are deformable through the entire tank volume. The tanks are fastened to the fuel distributor with V-band connections.

A temperature-controlled safety device for blowing off the fuels is provided as an electrically self-activating device and is electrically connected to at least one battery. The battery supplies electrical energy only after a predetermined, critical temperature of approx. 120° C. has been exceeded. Temperature sensors of the safety device are arranged on both tanks. The safety device is functionally coupled with the two gas generators and with the fuel valves of at least two mutually opposite rocket engines for their activation. The fuel valves are preferably coupled with electric motor actuators and are adjusted optionally by one of the fuel components.

According to a further aspect of the invention, the functional elements are designed as elements insensitive to gamma rays.

Thus, the thrust-generating device according to the present invention is a modular liquid-fuel rocket engine system with special safety technical features, which practically make its preferred use for military purposes possible in the first place.

Besides its principal field of use, the thrust-generating device according to the present invention may also be provided as a stand-by unit in various types of flying devices, as a temporary replacement for failed rudder surfaces, control rotors, etc., e.g., as a replacement for the tail rotor in helicopters.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
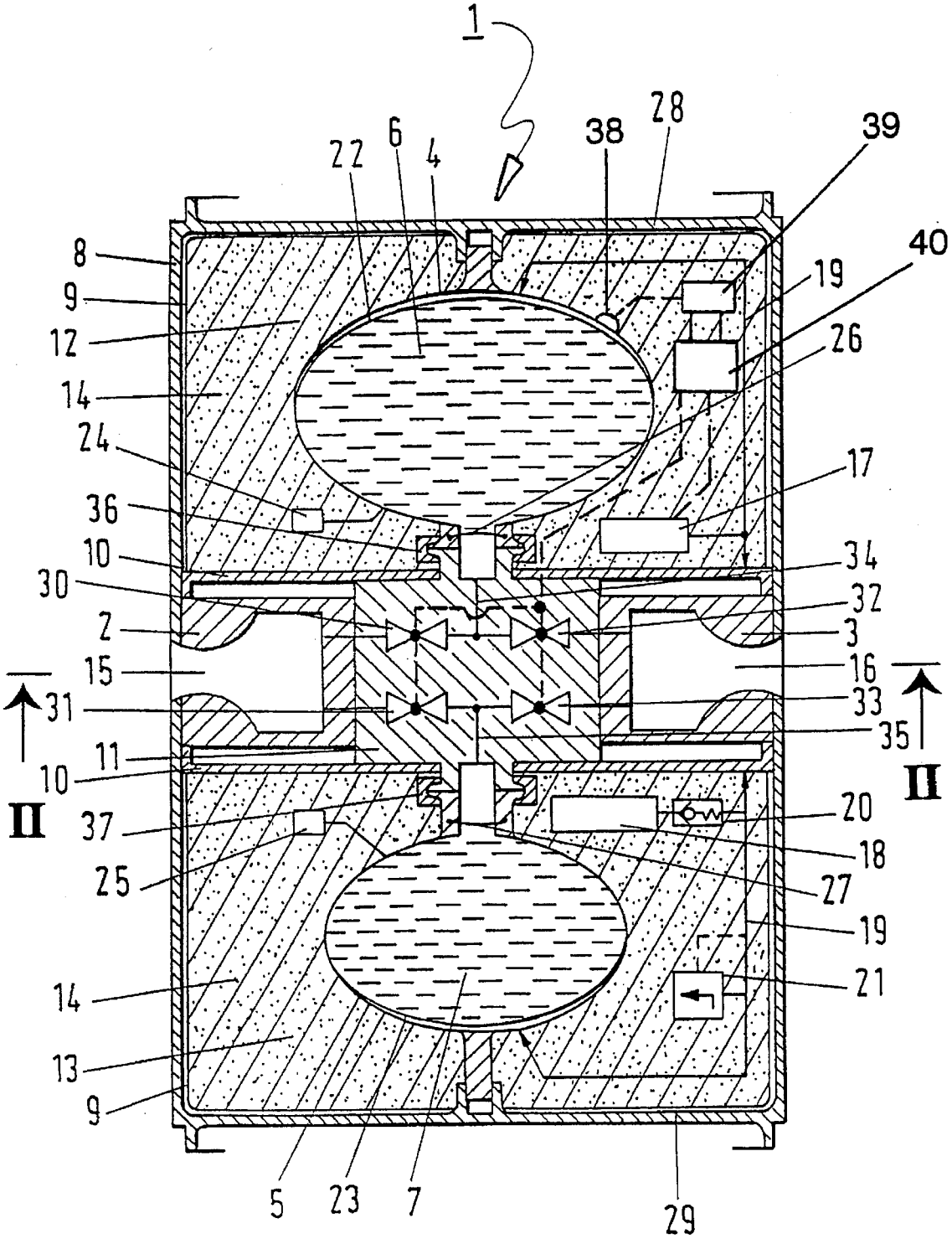
FIG. 1 is a highly simplified, partially schematic representation of a longitudinal central section through a thrust-generating device according to the invention.

Referring to the drawings in particular, the invention comprises a thrust-generating device 1 provided as a dosed, modular unit. The device 1 is intended as a lateral thrust-generating device for a missile or a rocket, which substantially improves the maneuverability of its carrier especially during the start phase and during the terminal phase thereof.

The main drive of the carrier, i.e., its longitudinal thrusting device, is independent from the thrust-generating device 1, and it may be designed, e.g., as a liquid-fuel rocket engine, a solid-fuel rocket engine, a ram jet rocket engine with liquid or solid fuel, or a turbojet engine. It is also possible to use carriers without a main drive of their own, e.g., terminal phase-guided shells, which are fired from barrel-type weapons.

In FIG. 1, the intended direction of fight and consequently the longitudinal direction of the thrust-generating device 1 is vertical, the lateral thrust plane defined by the engine arrangement is horizontal, and the tip of the carrier would be, e.g., above the module shown, and the main part of the carrier with the drive would be correspondingly under the module shown. The thrust-generating device 1 has a cylindrical shape with essentially flat front plates 28 and 29, which are used for fastening and in the area of which the connections for the external energy supply, data transmission, etc., are also arranged (not shown). The closed, metallic outer jacket 8 leaves free corresponding openings only in the area of the engine nozzles 15, 16 of the rocket engines 2, 3. There are preferably four engines offset by 90° in one plane, so that a specific control around the pitch axis and the yaw axis of the carrier becomes possible. The thrust directions of the two engines (not shown) thus extend downward and upward at right angles to the plane of the drawing. All engines are arranged within a central bulkhead 10 designed as a double diaphragm, and they are fastened to a block-like fuel distributor 11. The bulkhead 10 divides the volume defined by the outer shell 8 into an upper chamber 12 and a lower chamber 13, which are hermetically separated from one another. The tank 4 containing the oxidizing agent 6, e.g., $N_2O_4$ (dinitrogen tetroxide), is located in the upper chamber 12, and the tank 5 containing the fuel, e.g., ADH (asymmetric dimethylhydrazine), is in the lower chamber 13, so that the fuel components, which may react hypergolically, are also separated hermetically from one another. The stable bulkhead 10 with its massive "internal parts" is very unlikely to develop a leak even in the case of shelling. The empty spaces in the chambers 12 and 13 are provided with an adsorbent filling 14, which takes up and binds fuel escaping from a given tank in the case of leakage or shelling. In addition, the outer jacket 8 is covered on the inside with a so-called "self-sealing" film 9, which automatically closes hole-like damages produced by projectiles up to a certain degree and thus prevents granular adsorbent, which may contain fuel, from being discharged from the damaged outer shell 8. Such films have been known from, e.g., fighter airplane tanks. Even though the tanks 4, 5 are filled in the storage state of the thrust-generating device 1 for reasons of safety and readiness, they are pressureless, aside from the temperature-dependent inherent pressure of the fuels. The tightness of the filling connections 24 and 25 is guaranteed by cold welding after the filling process. Welded-in rupture disks 26, 27 ensure the tightness of the tanks 4, 5 on the outlet side. Pressure is admitted to the fuels 6, 7 for the purpose of delivering them from the tanks 4, 5 via a common pressurizing line 19, which passes through the bulkhead 10, only in the case of use. Elastieally/plastically deformable metallic diaphragms 22, 23 in the tanks 4, 5 separate the actual fuel from the pressurizing gas. The pressurizing gas is generated by a gas generator 17 with a shorter combustion time and by a gas generator 18 with a longer combustion time, and the gas generator 17 is provided for operation during the start phase of the carrier, and the gas generator 18 is provided for operation during the terminal phase of the flight mission of the carrier (homing).

An accidental ignition of the gas generator 18 by the propellant gases of the gas generator 17 is prevented by means of the nonreturn valve 20. Undesired high pressure peaks that may occur in the pressurizing system are prevented by the pressure relief valve 21. The first pressure pulse of the gas generator 17 destroys the tank outlet-side rupture disks 26 and 27, so that the fuels can flow to the fuel valves, here 30 through 33, and thus ultimately to the rocket engines, here 2 and 3. The fuel line 34 and the fuel valves 30 and 32 are provided for the oxidizing agent 6, and the fuel line 35 and the fuel valves 31 and 33 are provided for the fuel 7. The arrangement of the flow channels and functional elements in the block-like, massive fuel distributor 11 offers maximum safety against leakage, damage, etc. It should be mentioned in this connection that the tanks 4, 5 are fastened to the fuel distributor 11 by means of easy-to-mount and reliable V-band connections, and additional, radially acting support beatings (movable bearings) are provided toward the front plates 28, 29. The fuel valves are adjusted by the pressure of one of the two fuel components, and the adjustment process is controlled by electric motor operators (not shown). The adjusting function leads to slight losses of fuel, which are tolerable.

An electrical safety device, which is activated via temperature sensors 38 on the tanks 4, 5 and a safety device 41 brings about a pulse-free blow-off of the fuels through at least one pair of engines with mutually compensating thrust components, using the existing pressurizing and fuel system, is provided for the case in which the thrust-generating device 1 is exposed to unacceptably high outside temperatures. As a result, explosion of the fuel-filled thrust-generating generating device 1 in the case of fire is avoided. The power supply (battery) 39 of the safety device 40 to the fuel valves 30, 31, 32 and 33 is preferably initiated only by a temperature limit being exceeded, e.g., by the filling of the electrolyte into a battery. Control lines, shown as dash lines, extend from the sensor 38 to the battery 39 as well as from the safety device to the fuel valve 30, 31, 32 and 33.

In view of a possible use under the conditions of a nuclear attack, all functional elements of the thrust-generating device 1 are designed as elements insensitive to gamma rays and other radioactive radiation.

Figure 2:
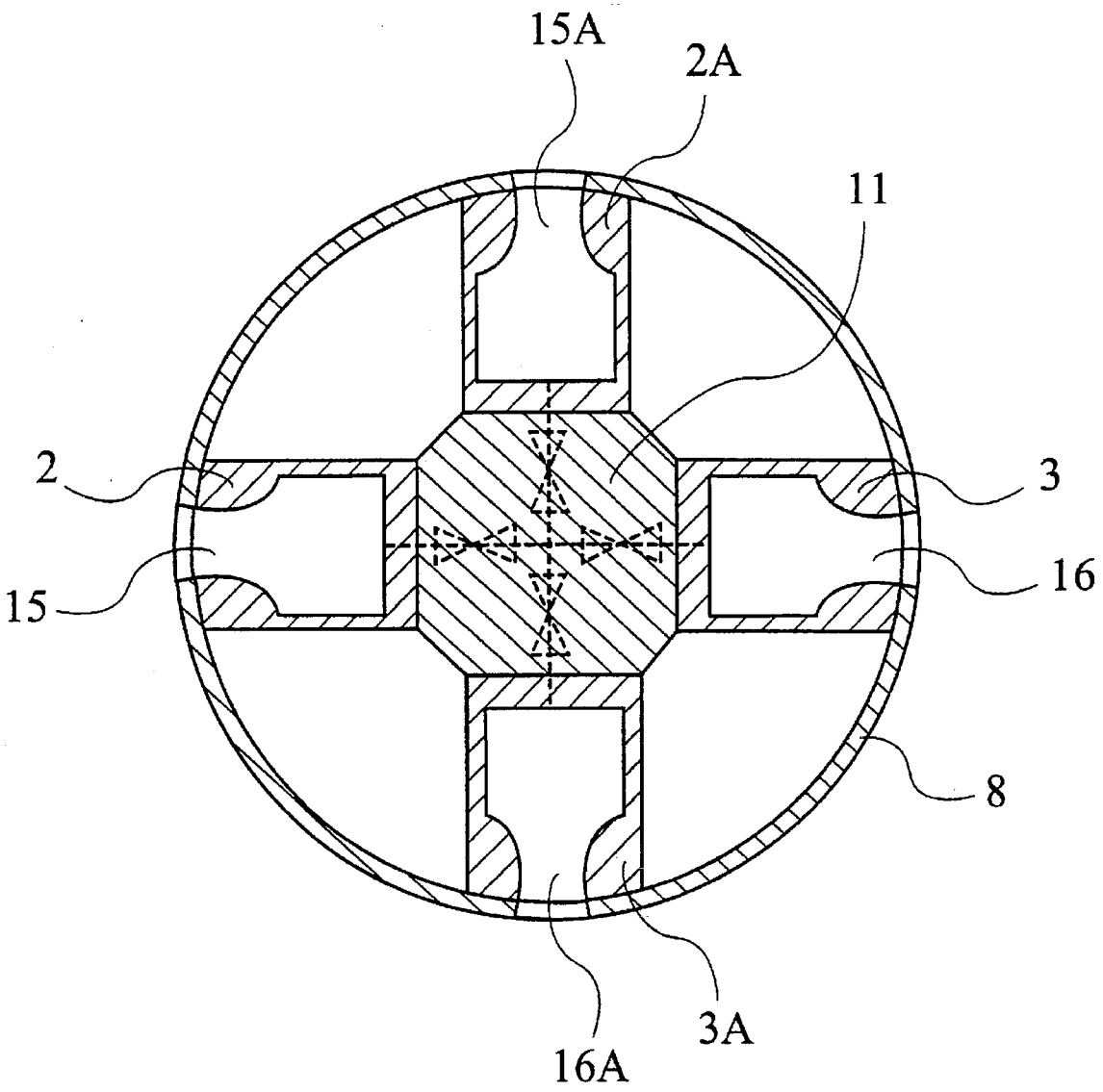
FIG. 2 is a partially schematic sectional view taken along line II—II of FIG. 1.

FIG. 2 shows the cross-shaped transverse arrangement of rocket engines, namely four rocket engines arranged, offset by an angle of 90° each, radially oriented, approximately in the center of the hollow cylindrical body. Rocket engines 2 and 3 as well as 2A and 3A are oriented in this manner. Each of the rocket engines has an associated engine nozzle, namely engine nozzles 15, 16 as well as 15*a* and 16*a*.

The metallic outer jacket 8 as well as the front plates 28 and 29 cooperate to define a Faraday cage, which is substantially closed except for the small local openings of the engine nozzle.

While a specific embodiment of the invention has been shown and described in detail to illustrate the application of the principles of the invention, it will be understood that the invention may be embodied otherwise without departing from such principles.

What is claimed is:

1. A thrust-generating device, comprising:

liquid fuel rocket engines arranged in pairs, said rocket engines of each pair having at least approximately equal thrusts and being disposed directed in opposite or approximately opposite directions of thrust;

fuel storage means for storing an amount of fuel, said fuel storage means being disposed adjacent to said rocket engines, said fuel storage means including tanks with a fuel supply tank separate from an oxidizing agent supply tank, said tanks being installed in a filled state and being in a pressureless state, except for the inherent pressure of the fuel, before activation of the thrust-generating device;

a closed, corrosion-resistant, modular unit, defining means that can be stored, rapidly mounted and removed, and can be activated and operated at any time from the outside via existing connections, said rocket engines and said fuel storage means being disposed in said modular unit, said modular unit including a central bulkhead; engine nozzles and a gas-tight, pressure-resistant outer jacket completely surrounding the device except for said engine nozzles, which are open to the outside, said outer jacket being lined on the inside with a self-sealing film, an inner volume of said modular unit being divided by said bulkhead into two separate chambers, said fuel tank being arranged on one side of said bulkhead, and said oxidizing agent tank, being arranged on the other side of said bulkhead, said tanks being directly or indirectly fastened to the central bulkhead, said module defining space in said two chambers on both sides of the bulkhead, said space being provided with an adsorbent filling;

a fuel distributor connecting said rocket engines to said tanks, said fuel distributor having a block-like design and being integrated with the engines within said central bulkhead; and temperature-controlled safety means for triggering a pulse-free blow-off of the fuels through one or more of said engine pairs.

2. Thrust-generating device in accordance with claim 1, wherein said outer jacket is formed as a metallic, hollow cylindrical body with extensively flat, rotationally symmetrical front plates, said front plates defining fastening support, said cylindrical body cooperating with said front plates to define a Faraday cage; said rocket engines including four rocket engines arranged, offset by an angle of 90° each, radially oriented, approximately in the center of said hollow cylindrical body; said central bulkhead is formed as a diaphragm double plate; said tanks including only one fuel tank and only one oxidizing agent tank, said fuel tank being separated from said oxidizing agent tank by said bulkhead.

3. Thrust-generating device in accordance with claim 1, further comprising two gas generators, each of which is connectable to said tanks for pressurizing said tanks, one of said gas generators is provided for a start phase, and the other of said gas generators is provided for the terminal phase of a flight mission; and said gas generator for said start phase has a shorter combustion time than said gas generator for said terminal phase.

4. Thrust-generating device in accordance with claim 2, further comprising two gas generators, each of which is conectable to said tanks for pressurizing said tanks, one of said gas generators is provided for a start phase, and the other of said gas generators is provided for the terminal phase of a flight mission; and said gas generator for said start phase has a shorter combustion time than said gas generator for said terminal phase.

5. Thrust-generating device in accordance with claim 3, comprising a pressurizing system including said gas generator and a pressurizing line connecting the generators to the tanks, said gas generator for said terminal of the flight mission is separated from said pressurizing line by a nonreturn valve, and at least one pressure relief valve is installed in the pressuring system.

6. Thrust-generating device in accordance with claim 4, further comprising a pressurizing system including said two gas generators and a pressurizing line connecting the gas generators to the tanks, said gas generator for said terminal phase of the flight mission is separated from said pressurizing line by a nonreturn valve, and at least one pressure relief valve is installed in the pressurizing system.

7. Thrust-generating device in accordance with claim 1, wherein said tanks include a filling connection for filling the tanks, said filling connection being dosed by cold welding; fuel lines being provided connected to said tanks, rupture disks being provided to close said tanks toward the fuel lines, said rupture disks having a bursting pressure which is lower than a tank pressurization operating pressure of said gas generators pressurizing the tanks; liquid fuels being provided in the tanks being sealed against the pressurizing gas by means of metallic diaphragms, said metallic diaphragms being deformable through an entire volume of an associated tank; V-band connections connecting said tanks to said fuel distributor.

8. Thrust-generating device in accordance with claim 3, wherein said temperature-controlled safety means includes an electrically self-activating device and is electrically connected to at least one battery, for supplying electrical energy only after a predetermined, critical temperature of approx. 120° C. has been exceeded; said fuel distributor includes fuel valves, said temperature-controlled safety means includes temperature sensors arranged on each of said tanks; said temperature-controlled safety means is connected to said two gas generators and with fuel valves of at least two mutually opposite rocket engines, for their activation.

9. Thrust-generating device in accordance with claim 1, wherein said fuel distributor includes fuel valves and electric motor actuators, said fuel valves being coupled with said electric motor actuators.

10. Thrust-generating device in accordance with claim 1, further comprising: protective means for protection against radioactive radiation, said protective means including the material forming the elements of the thrust generating device.

11. Thrust-generating device in accordance with claim 9, further comprising means for adjusting said fuel distributor based on the pressure of one of the fuel components.

12. A thrust-generating device, comprising:

a first pair of liquid fuel rocket engines with engine nozzles, said rocket engines of said first pair having at least approximately equal thrusts and being oriented to have opposite or approximately opposite directions of thrust;

a second pair of liquid fuel rocket engines with engine nozzles, said rocket engines of said second pair having at least approximately equal thrusts and being oriented to have opposite or approximately opposite directions of thrust, said first pair of rocket engines being disposed adjacent to said second pair of rocket engines;

fuel storage means for storing an amount of fuel, said fuel storage means being disposed adjacent to the rocket engines of said first pair and said second pair, said fuel storage means including tanks with a fuel supply tank separate from an oxidizing agent supply tank, said tanks being installed in a filled state and being non pressurized in an inactive state of the thrust-generating device, except for the inherent pressure of the fuel;

a closed, corrosion-resistant, modular unit, defining thrust generating device storage means for facilitating mounting and removing the thrust generating device, said rocket engines and said fuel storage means being disposed in said modular unit, said modular unit including a central bulkhead, engine nozzles and a gas-tight, pressure-resistant outer jacket completely surrounding the thrust generating device except for said engine nozzles, which are open to the outside, said outer jacket being lined on the inside with a self-sealing film, an inner volume of said modular unit being divided by said bulkhead into two separate chambers, said fuel supply tank being arranged on one side of said bulkhead, and said oxidizing agent supply tank, being arranged on the other side of said bulkhead said tanks being directly or indirectly fastened to the central bulkhead, said module defining space in said two chambers on both sides of the bulkhead, said space being provided with an adsorbent filling;

a fuel distributor connecting said rocket engines to said tanks, said fuel distributor having a block-like design and being integrated with said rocket engines within said central bulkhead whereby said rocket engines are activatable individually and in groups and are activatable for multiple ignition; and temperature-controlled safety means for triggering a pulse-free blow-off of the fuels through one or more of engine pairs.

13. A thrust-generating device in accordance with claim 12, wherein:

said outer jacket is formed as a metallic, hollow cylindrical body with extensively flat, rotationally symmetrical front plates, said cylindrical body cooperating with said front plates to define a Faraday cage;

said rocket engines include four rocket engines arranged, offset by an angle of 90° each, radially oriented, approximately in the center of said hollow cylindrical body;

said central bulkhead is formed as a diaphragm double plate; and said tanks include only one fuel tank and only one oxidizing agent tank, said fuel tank being separated from said oxidizing agent tank by said bulkhead.

14. A thrust-generating device in accordance with claim 12, further comprising two gas generators, each of which is connectable to said tanks for pressurizing said tanks, one of said gas generators is provided for a start phase, and the other of said gas generators is provided for the terminal phase of a flight mission; and said gas generator for said start phase has a shorter combustion time than said gas generator for said terminal phase.

15. Thrust-generating device in accordance with claim 13, further comprising two gas generators, each of which is connectable to said tanks for pressurizing said tanks, one of said gas generators is provided for a start phase, and the other of said gas generators is provided for the terminal phase of a flight mission; and said gas generator for said start phase has a shorter combustion time than said gas generator for said terminal phase.

16. Thrust-generating device in accordance with claim 14, further comprising a pressurizing system including said two gas generators and a pressurizing line connecting said two gas generators to the tanks, said two gas generators including a gas generator for said terminal phase of the flight mission separated from said pressurizing line by a nonreturn valve, and at least one pressure relief valve is installed in the pressurizing system.

17. Thrust-generating device in accordance with claim 15, further comprising a pressurizing system including said two gas generators and a pressurizing line connecting said two gas generators to the tanks, said two gas generators including a gas generator for said terminal phase of the flight mission separated from said pressurizing line by a non-return valve, and at least one pressure relief valve is installed in the pressurizing system.

18. A thrust-generating device in accordance with claim 12, wherein:

said tanks include a filling connection for filling the tanks, said filling connection being closed by cold welding;

fuel lines are provided connected to said tanks, rupture disks being provided to close said tanks toward the fuel lines, said rupture disks having a bursting pressure which is lower than a tank pressurization operating pressure of said gas generators pressurizing the tanks;

liquid fuels are provided in said tanks sealed against the pressurizing gas by means of metallic diaphragms; said metallic diaphragms being deformable through an entire volume of an associated tank; and V-band connections are provided connecting said tanks to said fuel distributor.

19. A thrust-generating device in accordance with claim 14, wherein said temperature-controlled safety means includes an electrically self-activating device and is electrically connected to at least one battery for supplying electrical energy only after a predetermined critical temperature of approx. 120° C. has been exceeded; said fuel distributor includes fuel valves, said temperature-controlled safety means includes temperature sensors arranged on each of said tanks; said temperature-controlled safety means is connected to said two gas generators and with fuel valves of at least two mutually opposite rocket engines for their activation.

20. A thrust-generating device in accordance with claim 12, wherein said fuel distributor includes fuel valves and electric motor actuators, said fuel valves being coupled with said electric motor actuators means for adjusting said fuel distributor based on the pressure of one of the fuel components.

* * * * *